United States Patent [19]

Fukada et al.

[11] Patent Number: 4,471,339

[45] Date of Patent: Sep. 11, 1984

[54] HIGH-VOLTAGE VARIABLE RESISTOR

[75] Inventors: Yutaka Fukada, Katano; Noriya Nishimura, Osaka; Yuzo Ohta, Moriguchi; Yohei Shimizu, Nishinomiya; Mituru Kohda, Osaka, all of Japan

[73] Assignee: Sanyo Electric Co., Ltd., Osaka, Japan

[21] Appl. No.: 398,324

[22] Filed: Jul. 15, 1982

[30] Foreign Application Priority Data

Jul. 15, 1981 [JP] Japan ..... 56-105654[U]
Jul. 30, 1981 [JP] Japan ..... 56-114054[U]
Nov. 16, 1981 [JP] Japan ..... 56-170982[U]

[51] Int. Cl.[3] ..... H01C 10/32

[52] U.S. Cl. ..... 338/162; 338/164; 338/184

[58] Field of Search ..... 338/160–164, 338/166, 167, 169, 171, 174, 188, 184, 322

[56] References Cited

U.S. PATENT DOCUMENTS 3,531,755 9/1970 Michok ..... 338/162
4,400,685 8/1983 Chestnut ..... 338/167

*Primary Examiner*—C. L. Albritton
*Attorney, Agent, or Firm*—Armstrong, Nikaido, Marmelstein & Kubovcik

[57] ABSTRACT

A high-voltage variable resistor including a substrate, a sliding member provided so as to be rotated in sliding contact with the substrate, a casing for accommodating the substrate and sliding member in it, a plurality of connecting terminals connected to the substrate and sliding member, and a rotational rod coupled with the sliding member. The resistor further includes a plurality of springs for electrically connecting, respectively, the connecting terminals to the substrate so that the connecting terminals may be disposed in parallel with opposite surfaces of the substrate.

8 Claims, 24 Drawing Figures

HIGH-VOLTAGE VARIABLE RESISTOR

BACKGROUND OF THE INVENTION

The present invention generally relates to a resistor and more particularly, to a high-voltage variable resistor, for example, a focusing variable resistor for use in a television set.

Although conventionally, for example, a flyback transformer for use with the high-voltage variable resistor has been especially designed to suppress its voltage regulation and to minimize variations in the width of pictures on a screen of a television set, such voltage regulations may alternatively be restricted to a small value by causing a large current to flow through the high-voltage variable resistor for supplying focusing voltage and screen voltage to the cathode-ray tube of the television set.

A table 1 below shows one example of relations of total resistance RT of the high-voltage variable resistor connected to the flyback transformer, variations in width of pictures on the screen, and voltage regulation of the flyback transformer.

TABLE 1

| | | | | |
|---|---|---|---|---|
| Total resistance RT (MΩ) | 100 | 75 | 67 | 50 |
| Variations in width of pictures on screen (mm) | 8 | 6 | 5 | 3 |
| Voltage regulation (KV) | 3.75 | 3.60 | 3.55 | 3.35 |

It is to be noted that voltage applied to the high-voltage variable resistor in Table 1 is approximately 13.5 KV. It is easily understood from Table 1 that characteristics of the flyback transformer can be remarkably improved by reducing the total resistance RT. Meanwhile, reduction in the total resistance RT will increase load for the high-voltage variable resistor, thus raising temperature of the high-voltage variable resistor by Joule's heat.

Conventionally, in high-voltage variable resistors, it has been so arranged as shown in FIGS. 1(*a*) to 1(*d*) that connecting terminal pins 3*a* for receiving a high voltage supplied from a flyback transformer, 3*b* for supplying a focusing voltage, 3*c* for supplying a screen voltage, and 3*d* for grounding or earthing are soldered to an insulating substrate 1 at right angles thereto. More specifically, the plate-like rectangular insulating substrate 1 is made of sintered alumina or ceramics, etc. and has a front face 1A and a rear face 1B. It should be noted here that all directional indications such as "front", "rear", "upper", "lower", etc. are based on the illustration in FIGS. 1(*c*) and 1(*d*), hereinbelow. On the front face 1A of the insulating substrate 1, a resistor portion or layer 1*c* of a curved shape, a first electrically conductive portion 1*e* of a bent shape and a second electrically conductive portion 1*g* of a linear shape are printed and baked. The resistor portion 1*c* is formed so as to extend downwardly in a zigzag manner along a left side edge on the front face 1A of the substrate 1 and includes an electrode 1*h* for the connecting terminal pin 3*a*, provided at an upper end thereof, a first circular portion 1*a*, a second circular portion 1*b*, and an electrode 1*i* for the connecting terminal 3*d*, provided at a lower end thereof. The first electrically conductive portion 1*e* is formed so as to extend downwardly generally in a V-shape on an upper right portion of the front face 1A and includes an electrode 1*j* for the connecting terminal pin 3*b*, provided at an upper end thereof and a first central portion 1*d* which is provided at an lower end thereof so as to be disposed at the center of the first circular portion 1*a* of the resistor portion 1*c*. The second electrical conductive portion 1*g* is formed so as to extend laterally on a lower right portion of the front face 1A and includes an electrode 1*k* for the connecting terminal pin 3*c*, provided at a right end thereof and a second central portion 1*f* which is provided at a left end thereof so as to be disposed at the center of the second circular portion 1*b* of the resistor portion 1*c*. Thus, the electrodes 1*h*, 1*i*, 1*j* and 1*k* are formed at four corner portions of the front face 1A so as to be disposed in a symmetric relation with respect to corresponding four corners of the front face 1A. Since the first circular portion 1*a* is disposed above the second circular portion 1*b*, the first central portion 1*d* and second central portion 1*f* are provided approximately at the center in the lateral direction of the front face 1A with the first central portion 1*d* being disposed above the second central portion 1*f*. The electrodes 1*h*, 1*i*, 1*j* and 1*k* are formed with through-openings 1*h*', 1*i*', 1*j*' and 1*k*', respectively. Through-holes 1*l* and 1*m* are formed on the front face 1A so as to be, respectively, disposed above the first circular portion 1*a*, and between the first circular portion 1*a* and the second circular portion 1*b*. The electrodes 1*h*, 1*i*, 1*j* and 1*k*, first central portion 1*d* and second central portion 1*f* are provided with electrically conductive paste mainly consisting of silver.

The insulating casing 6 is made of synthetic resin and is formed into a rectangular shape. The insulating casing 6 includes a frontf wall 6H, an upper side wall 6D, a lower side wall 6E, a left side wall 6F and a right side wall 6G with the rear face 6B being not formed with a wall, a rectangular accommodation recess for accommodating the insulating substrate 1 therein, which is enclosed by the front wall 6H, upper side wall 6D, lower side wall 6E, left side wall 6F and right side wall 6G is provided in the insulating casing 6. An upper cylindrical boss 6I and a lower cylindrical boss 6J each provided with a through-hole are integrally formed with the insulating casing 6 on the front face 6A and at the center in the lateral direction of the insulating casing 6. Further, an upper cylindrical projection 6*a* and a lower cylindrical projection (not shown) each extending over a slight distance from one face of the front wall 6H opposite to the front face 6A in a direction remote from the front face 1A are integrally formed with the insulating casing 6 and are, respectively, disposed at the center in the lateral direction of the insulating casing 6 above the through-hole of the upper cylindrical boss 6I and between the through-hole of the upper cylindrical boss 6I and the through-hole of the lower cylindrical boss 6J. The upper side wall 6D includes a front wall portion 6D*a* and a rear wall portion 6D*b* with the front wall portion 6D*a* being slightly larger, in thickness, than the rear wall portion 6D*b*. Likewise, the lower side wall 6E, left side wall 6F and right side wall 6G include front wall portions and rear wall portions, respectively, so that a rectangular bearing face 6C for supporting the insulating substrate 1 is formed on side edges of the front wall portion 6D*a* and the front wall portions of the lower side wall 6E, left side wall 6F and right side wall 6G at the joint with the rear wall portion 6D*b*, and the rear wall portions of the lower side wall 6E, left side wall 6F and right side wall 6G, respectively.

The conventional high-voltage variable resistors are further provided with an adjusting rod 4 for adjusting the focusing voltage through manual rotation thereof and an adjusting rod 5 for adjusting the screen voltage through manual rotation thereof. The adjusting rod 4 has a knurled portion 4*a* formed at one end thereof for facilitating the rotation and a flange portion 4*b* formed at the other end thereof. Similarly, the adjusting rod 5 has a knurled portion 5*a* and a flange portion (not shown). An elongated first sliding member 2*a* having one end 2*a*1 and the other end 2*a*2 is fixedly attached to one face of the flange portion 4*b* remote from the knurled portion 4*a* with the other end 2*a*2 being disposed concentrically with the axis of the adjusting rod 4. In the same manner as described above, an elongated second sliding member (not shown) having one end and the other end is fixedly attached to one face of the flange portion of the adjusting rod 5 remote from the knurled portion 5*a* with the other end of the second sliding member being disposed concentrically with the axis of the adjusting rod 5. The connecting terminal pins 3*a* for receiving the high voltage supplied from the flyback transformer, 3*b* for supplying the focusing voltage, 3*c* for supplying the screen voltage, and 3*d* for earthing are, respectively, fitted into the through-openings 1*h'*, 1*j'*, 1*k'* and 1*d'* of the insulating substrate 1 so as to extend therethrough and then, are soldered to the insulating substrate 1 on the front face 1A. Accordingly, deposited solder portions 9 are formed at the through-openings 1*h'*, 1*i'*, ij, and 1*k'* on the front face 1A. It should be noted that flux deposited on the insulating substrate 1 during the soldering causes deterioration in electrical insulation of the insulating substrate 1 and therefore, is removed from the insulating substrate 1 by washing. When the adjusting rod 4 for adjusting the focusing voltage and the adjusting rod 5 for adjusting the screen voltage are, respectively, fitted into the through-hole of the upper cylindrical boss 6I and the through-hole of the lower cylindrical boss 6J in a direction from the rear face 6B to the front face 6A so that the other face of the flange portion 4*b* adjacent to the knurled portion 4*a* and the other face of the flange portion of the adjusting rod 5 adjacent to the knurled portion 5*a* may be brought into contact with the one face of the front wall 6H remote from the front face 6A with the sliding members 2*a* and 2*b* being, respectively, secured to the flange portion 4*b* of the adjusting rod and the flange portion of the adjusting rod 5, the knurled portions 4*a* and 4*b* project out of the upper cylindrical boss 6I and lower cylindrical boss 6J, respectively. Then, the insulating substrate 1 having the connecting terminal pins 3*a*, 3*b*, 3*c* and 3*d* soldered thereto are fitted into the accommodation recess of the insulating casing 6 so as to be positioned through fitting of the upper cylindrical projection 6*a* and lower cylindrical projection 6*b* into the respective through-holes 1*l* and 1*m* so that a part of each of the upper cylindrical projection 6*a* and lower cylindrical portion 6*b* may project out of the rear face 1B of the insulating substrate 1. The insulating substrate 1 is fixedly attached to the insulating casing 6 by securing the part of each of the upper cylindrical projection 6*a* and lower cylindrical projection 6*b* projecting out of the rear face 1B, through melting thereof, to the rear face 1B with peripheral portions of the front face 1A of the insulating substrate 1 being in contact with the bearing face 6C of the insulating casing 6, whereby the connecting terminal pins 3*a*, 3*b*, 3*c* and 3*d* project out of the rear face 6B of the insulating casing 6 at right angles to the insulating substrate 1 so as to be electrically connected to the flyback transformer.

Furthermore, since a relatively high voltage is applied to the connecting terminal pins 3*a*, 3*b* and 3*c*, the connecting terminal pins 3*a*, 3*b* and 3*c* are, respectively, partially protected by cylindrical insulating covers 7*a*, 7*b* and 7*c*. It is to be noted that, since a voltage applied to the connecting terminal pin 3*d* for earthing is relatively low, the connecting terminal pin 3*d* is not required to be protected by an insulating cover.

Subsequently, thermosetting resin 8 such as epoxy resin, etc. is applied to the whole surface of the rear face 1B of the insulating substrate 1 up to the rear face 6B of the insulating casing 6 for the purpose of electrically insulating the insulating substrate 1, absorbing an impact to be applied to the connecting terminal pins 3*a*, 3*b*, 3*c* and 3*d* and fixing the insulating covers 7*a*, 7*b* and 7*c* in position. Accordingly, thickness of the thermosetting resin 8 is required to be sufficiently large therefor.

In the above described arrangement of the prior art high-voltage variable resistor, the one end 2*a*1 of the first sliding member 2*a* fixedly attached to the flange portion 4*b* of the adjusting rod 4 is caused to make a circular motion along and in sliding contact with the first circular portion 1*a* of the resistor portion 1*c* upon manual rotation of the adjusting rod 4 with the other end 2*a*2 being in contact with the first central portion 1*d* of the first electrically conductive portion 1*e*. Likewise, the one end of the second sliding member fixedly attached to the flange portion of the adjusting rod 5 is caused to make a circular motion along and in sliding contact with the second circular portion 1*b* upon manual rotation of the adjusting rod 5 with the other end of the second sliding member being in contact with the second central portion 1*f* of the second electrically conductive portion 1*g*. Accordingly, a high voltage supplied from the flyback transformer to the connecting terminal pin 3*a* is lowered by a part of the resistor portion 1*c* extending from the electrode 1*h* to the first circular portion 1*a* and then, is varied upon manual rotation of the adjusting rod 4 so as to supply the focusing voltage from the connecting terminal pin 3*b* owing to electrical contact of the first circular portion 1*a* of the resistor portion 1*c* by the first central portion 1*d* of the first electrically conductive portion 1*e* through the first sliding member 2*a*.

The focusing voltage is further lowered by another part of the resistor portion 1*c* extending from the first circular portion 1*a* to the second circular portion 1*b* and then, is varied upon manual rotation of the adjusting rod 5 so as to supply the screen voltage from the connecting terminal pin 3*c* owing to electrical contact of the second circular portion 1*b* of the resistor portion 1*c* by the second central portion 1*f* of the second electrically conductive portion 1*g* through the second sliding member.

However, the known high-voltage variable resistors have such a disadvantage that, when the connecting terminal pins 3*a*, 3*b*, 3*c* and 3*d* are subjected to a large bending moment, the deposited solder portions 9 tend to be separated from the insulating substrate 1, resulting in faulty electrical conduction between the connecting terminal pins 3*a*, 3*b*, 3*c* and 3*d* and the insulating substrate 1. Meanwhile, even if it is so arranged that a force applied to the connecting terminal pins 3*a*, 3*b*, 3*c* and 3*d* is absorbed by the thermosetting resin 8, it becomes necessary to inject a greater amount of the thermosetting resin 8 than required for electrical insulation.

Furthermore, the prior art high-voltage variable resistors have such an inconvenience that, if flux used for soldering of the connecting terminal pins 3*a*, 3*b*, 3*c* and 3*d* to the insulating substrate 1 is not completely removed from the insulating substrate 1 by a washing process and remains on the insulating substrate 1, creeping discharge undesirably takes place on the front face 1A of the insulating substrate 1.

Moreover, the conventional high-voltage variable resistors have been disadvantageous in that, unless a strict control over materials of the solder is exercised, an undesirable phenomenon that dewetting of the solder is caused through diffusion, in the solder, of silver contained in the electrically conductive paste takes place at the electrodes 1*h*, 1*i*, 1*j* and 1*k* provided with the electrically conductive paste, thus resulting in faulty soldering.

The conventional high-voltage varible resistors have such an disadvantage that, since the insulating casing 6 or the insulating covers 7*a*, 7*b* and 7*c* are deformed by heating of the thermosetting resin 8 for curing thereof, the connecting terminal pins 3*a*, 3*b*, 3*c* and 3*d* are not positively held by the insulating casing 6, thereby causing displacement of the connecting terminal pins 3*a*, 3*b*, 3*c* and 3*d*.

Furthermore, although thickness of the thermosetting resin 8 is required to be sufficiently large as described above, the thermosetting resin 8 has a low thermal conductivity of approximately $10^{-3}$ cal/cm-.sec..°C., so that heat produced at the resistor portion 1*c* is not emitted out of the insulating casing 6 if the thickness of the thermosetting resin 8 is quite large and thus, temperature in the insulating casing 6 rises considerably, thereby resulting in deterioration of elasticity of the thermosetting resin 8 and sliding members 2*a* and 2*b* or degradation of the resistor portion 1*c*. Accordingly, the known high-voltage variable resistors have such an inconvenience that since load applied to one unit area of the insulating substrate 1 is restricted to some value, the insulating substrate 1 is required to have a large area if a high-voltage variable resistor for large electric currents is to be produced.

SUMMARY OF THE INVENTION

Accordingly, an essential object of the present invention is to provide an improved high-voltage variable resistor which eliminates the need for a soldering process and a flux washing process, with substantial elimination of disadvantages inherent in conventional high-voltage resistors of this kind.

Another important object of the present invention is to provide an improved high-voltage variable resistor of the above described type which is simple in structure, highly reliable in actual use and suitable for mass production at low cost.

In accomplishing these and other objects according to one preferred embodiment of the present invention, there is provided an improved high-voltage variable resistor including a substrate provided with a resistor portion having at least one circular portion, with said resistor portion being formed on one of opposite surfaces of said substrate, a sliding member provided so as to confront said one of said opposite surfaces of said substrate and be rotated in sliding contact with said circular portion of said resistor portion of said substrate, a casing for accommodating said substrate and said sliding member therein, a plurality of connecting terminals connected to said resistor portion and said sliding member, and a rotational rod coupled with said sliding member so as to rotate said sliding member with a part of each of said connecting terminals and a part of said rotational rod projecting out of said casing, said high-voltage variable resistor comprising:

a plurality of springs for electrically connecting said connecting terminals to said substrate;

said connecting terminals being disposed in parallel with said opposite surfaces of said substrate.

In accordance with the present invention, since the connecting terminal pins are disposed in parallel with the opposite surfaces of the insulating substrate and the connecting terminal pins are electrically connected to the insulating substrate through the springs, it becomes unnecessary to perform the soldering process and the flux washing process.

Furthermore, in accordance with the present invention, even if a large external force is applied to the connecting terminal pins, damage to the insulating substrate and improper contact between the insulating substrate and the connecting terminal pins are desirably eliminated, whereby working efficiency and reliability of the high-voltage variable resistor have been remarkably improved.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1A:
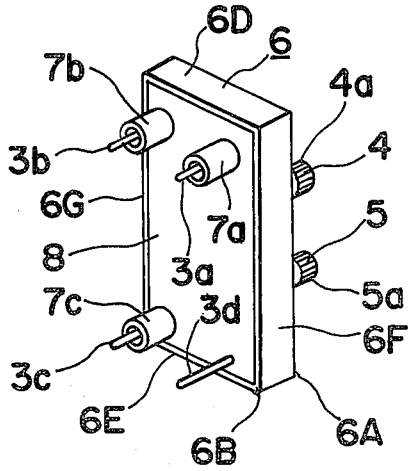
Fig. 1(a) PRIOR ART
FIG. 1(*a*) is a perspective view of a conventional high-voltage variable resistor, FIG. 1(*b*) is a side elevational view, partly in section, of the high-voltage variable resistor of FIG. 1(*a*), FIG. 1(*c*) is a front elevational view of an insulating substrate employed in the high-voltage variable resistor of FIG. 1(*a*), FIG. 1(*d*) is a front elevational view of the high-voltage variable resistor of FIG. 1(*a*), FIG. 2(*a*) is a view similar to FIG. 1(*a*), showing a high-voltage variable resistor according to a first embodiment of the present invention, FIG. 2(*b*) is a view similar to FIG. 1(*b*), showing the high-voltage variable resistor of FIG. 2(*a*), FIG. 2(*c*) is a view similar to FIG. 1(*c*), showing an insulating substrate employed in the high-voltage variable resistor of FIG. 2(*a*)
Figure 1B:
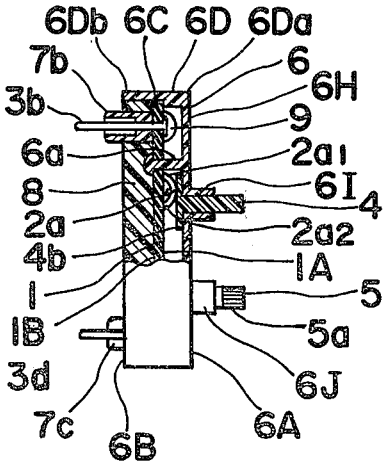
Fig. 1(b) PRIOR ART
Figure 1C:
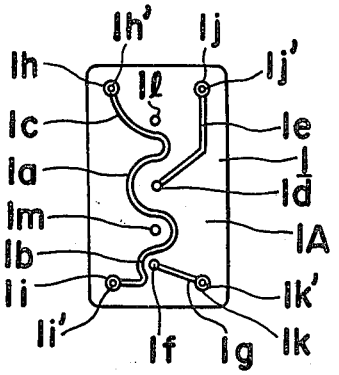
Fig. 1(c) PRIOR ART
Figure 1D:
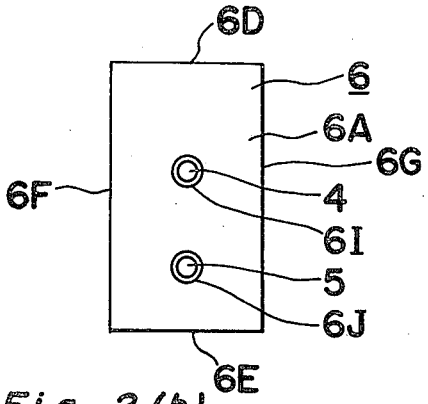
Fig. 1(d) PRIOR ART
Figure 2A:
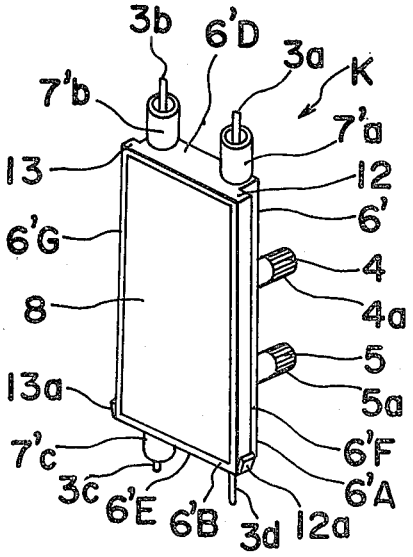
Figure 2B:
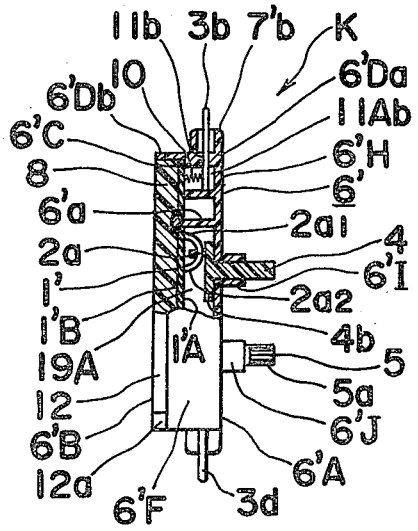
Figure 2C:
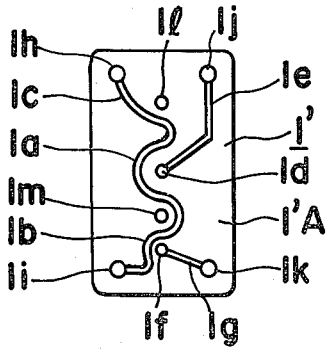
Figure 3:
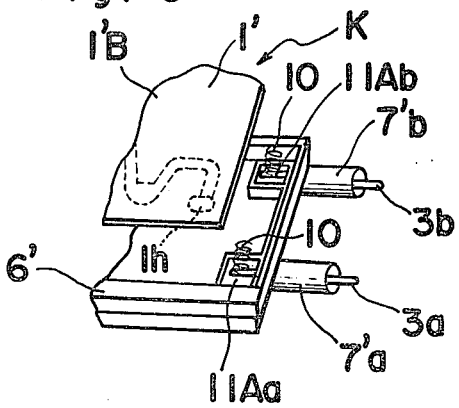
FIG. 3 is a fragmentary perspective view of the high-voltage variable resistor of FIG. 2(*a*) with the insulating substrate being removed therefrom, FIGS. 4(*a*), 4(*b*) and 4(*c*) are views showing on an enlarged scale springs of various configurations employed in the high-voltage variable resistor of FIG. 2(*a*), FIG. 5(*a*) is a view similar to FIG. 2(*b*), showing on an enlarged scale a high-voltage variable resistor according to a second embodiment of the present invention, FIG. 5(*b*) is a view explanatory of assembly of the high-voltage variable resistor of FIG. 5(*a*), FIGS. 5(*c*) and 5(*d*) are views similar to FIG. 4(*a*), showing springs of various configurations employed in the high-voltage variable resistor of FIG. 5(*a*), FIGS. 6(*a*) and 6(*b*) are views showing on an enlarged scale connecting terminal pins employed in the high-voltage variable resistor of FIG. 5(*a*)

Referring now to the drawings, there is shown in FIGS. 2(*a*) to 2(*c*), 3 and 4(*a*) to 4(*c*), a high voltage variable resistor K according to a first embodiment of the present invention.

The high voltage variable resistor K includes an insulating substrate 1' having a front face 1'A and a rear face 1'B, an insulating casing 6' having a front face 6'A and a rear face 6'B, and an electrically conductive coiled spring 10. It is to be noted that the insulating substrate 1' is equal, in the arrangements, to the insulating substrate 1 except that the electrodes 1*h*, 1*i*, 1*j* and 1*k* of the insulating substrate 1' are not, respectively, formed with the through-openings 1*h*', 1*i*', 1*j*' and 1*k*' of the conventional high-voltage variable resistor as shown in FIG. 2(*c*).

The insulating casing 6' includes a front wall 6'H, an upper side wall 6'D, a lower side wall 6'E, a left side wall 6'F and a right side wall 6'G. The upper side wall 6'D includes a front wall portion 6'D*a* and a rear wall portion 6'D*b* which is smaller, in thickness, than the front wall portion 6'D*a*. Likewise, the lower side wall 6'E, left side wall 6'F and right side wall 6'G includes front wall portions and rear wall portions, respectively, so that a rectangular bearing face 6'C for supporting the insulating substrate 1' is formed on side edges of the front wall portion 6'D*a*, and the front wall portions of the lower side wall 6'E, left side wall 6'F and right side wall 6'G at the joint with the rear wall portion 6'D*b*, and the rear wall portions of the lower side wall 6'E, left side wall 6'F and right side wall 6'G, respectively.

The insulating casing 6' has a through-opening (not shown) and a through-opening 11*b* formed, respectively, adjacent to the left side wall 6'F and right side wall 6'G on the front wall portion 6'D*a* of the upper side wall 6'D. Likewise, the insulating casing 6' further has through-openings (not shown) formed, respectively, adjacent to the right side wall 6'G and left side wall 6'F on the front wall portion of the lower side wall 6'E.

Annular insulating covers 7'*a* and 7'*b* are integrally formed with the insulating casing 6' in concentricity with the through-opening formed adjacent to the left side wall 6'F on the front wall portion 6'D*a* and the through-opening 11*b*, respectively, so as to project out of the upper side wall 6'D in parallel with the front face 6'A. Likewise, an annular insulating cover 7'*c* is integrally formed with the insulating casing 6' in concentricity with the through-opening formed adjacent to the right side wall 6'G on the front wall portion of the lower side wall 6'E so as to project out of the lower side wall 6'E in parallel with the front face 6'A.

Furthermore, as shown in FIGS. 2(*b*) and 3, L-shaped walls are provided at the four corners of the front wall 6'H on one face of the front face 6'H opposite to the front face 6'A so as to form rectangular space portions 11A*a* and 11A*b*, and two other rectangular space portions formed, respectively, at the lower right and lower left corners of the front wall 6'H on the one face of the front wall 6'H opposite to the front face 6'A which are communicated with the through-opening extending concentrically with the insulating cover 7'*a*, through-opening 11*b*, through-opening extending concentrically with the insulating cover 7'C and through-opening formed adjacent to the left side wall 6'F on the front wall portion of the lower side wall 6'E, respectively. The L-shaped walls are formed slightly smaller, in height, than the front wall portion 6'D*a*, and the front wall portions of the lower side wall 6'E, left side wall 6'F and right side wall 6'G.

The left side wall 6'F and right side wall 6'G have, respectively, guide rails 12 and 13 which are formed adjacent to the rear face 6'B so as to extend from the upper side wall 6'D to the lower side wall 6'E. The guide rails 12 and 13 have, respectively, lugs 12*a* and 13*a* formed adjacent to the lower side wall 6'E.

It is to be noted that a flyback transformer for use with the high-voltage variable resistor K has guide grooves corresponding to the guide rails 12 and 13 and the guide grooves further have engagement recesses for engagement with the lugs 12*a* and 13*a*, respectively. It is so arranged that, when the high-voltage variable resistor K is mounted on the flyback transformer, the guide rails 12 and 13 are, respectively, fitted downwardly into the guide grooves of the flyback transformer so that the high-voltage variable resistor K may be securely held by the flyback transformer through engagement of the lugs 12*a* and 13*a* by the respective engagement recesses.

In the above described arrangements of the high-voltage variable resistor K, the connecting terminal pins 3*a*, 3*b*, 3*c* and 3*d* are, respectively, fitted, in parallel with the insulating substrate 1', into the through-opening extending concentrically with the insulating cover 7'*a*, through-opening 11*b*, through-opening extending concentrically with the insulating cover 7'*c* and through-opening formed adjacent to the left side wall 6'F on the front wall portion of the lower side wall 6'E so as to extend into the space portions 11A*a* and 11A*b*, and the space portions formed, respectively, at the lower right and lower left corners of the front wall 6'H on the one face of the front wall 6'H opposite to the front face 6'A. The electrically conductive coiled springs 10 are, respectively, provided in pressing contact with the electrode 1*h* and the connecting terminal pin 3*a* in the space portion 11A*a*, in pressing contact with the electrode 1*j* and the connecting terminal pin 3*b* in the space portion 11A*b*, in pressing contact with the electrode 1*k* and the connecting terminal pin 3*c* in the space portion for the connecting terminal pin 3*c* and in pressing contact with the electrode 1*i* and the connecting terminal pin 3*d* in the space portion for the connecting terminal pin 3*d*, whereby the connecting terminal pins 3*a*, 3*b*, 3*c* and 3*d* are electrically connected to the insulating substrate 1'.

Figure 4A:
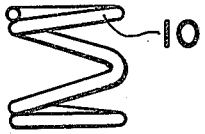
Figure 4B:
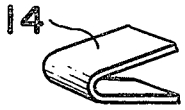
Figure 4C:
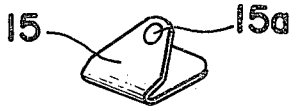
Figure 5A:
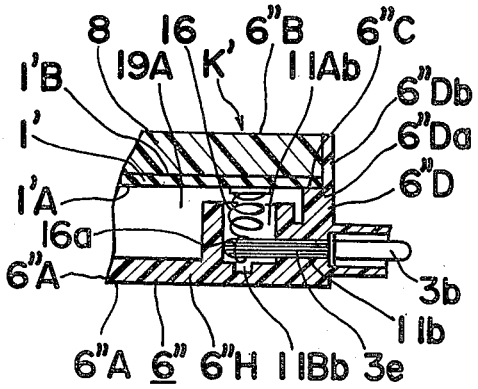
Figure 5B:
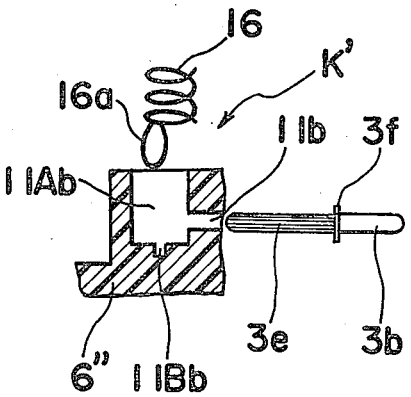
Figure 5C:
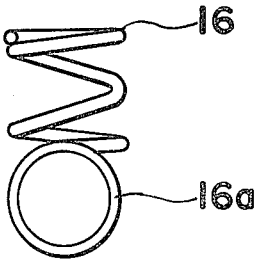
Figure 5D:
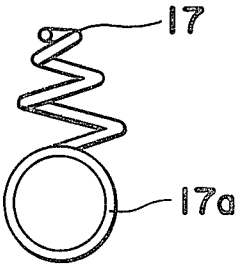

Meanwhile, the coiled spring 10 best shown in FIG. 4(*a*) can be replaced by a V-shaped spring plate 14 shown in FIG. 4(*b*) or a V-shaped spring plate 15 having a projecting contact 15*a* formed on one side thereof by, for example, press working for engagement with each of the electrodes 1*h*, 1*i*, 1*j* and 1*k*. Since other constructions of the high-voltage variable resistor K are similar to those of the conventional high-voltage variable resistor shown in FIGS. 1(*a*) to 1(*d*), description thereof is abbreviated by brevity.

Referring to FIGS. 5(*a*) to 5(*d*), 6(*a*) and 6(*b*), there is shown a high-voltage variable resistor K′ according to a second embodiment of the present invention.

The high-voltage variable resistor K′ includes an insulating casing 6″ having a front face 6″A and a rear face 6″B and a coiled spring 16 having a ring portion 16*a* through which each of the connecting terminal pins 3*a*, 3*b*, 3*c* and 3*d* is inserted. As shown in FIG. 5(*a*), a groove 11B*b* is formed in the space portion 11A*b* on one face of a front wall 6″H opposite to the front face 6″A so as to receive a part of the ring portion 16*a* of the coiled spring 16. In the same manner as described above, three other grooves are, respectively, formed in the space portion 11A*a* and the space portion for the connecting terminal 3*c* and the space portion for the connecting terminal pin 3*d*.

In the above described arrangements of the high-voltage variable resistor K′, firstly the coiled springs 16 are, respectively, accommodated into the space portions 11A*a* and 11A*b* and the space portion for the connecting terminal pin 3*c* and the space portion for the connecting terminal pin 3*d* so that the ring portion 16*a* may be fitted into each of the groove for the connecting terminal pin 3*a*, groove 11B*b*, groove for the connecting terminal pin 3*c* and groove for the connecting terminal pin 3*d*. Then, the connecting terminal pins 3*a*, 3*b*, 3*c* and 3*d* are, respectively, fitted into the through-opening extending concentrically with the insulating cover 7′*a*, through-opening 11*b*, through-opening extending concentrically with the insulating cover 7′*c* and through-opening for the connecting terminal pin 3*d* so as to extend through the ring portions 16*a*. It is to be noted that the groove for the connecting terminal pin 3*a*, groove 11B*b*, groove for the connecting terminal pin 3*c* and groove for the connecting terminal pin 3*d* are provided for positioning the ring portions 16*a* so as to facilitate insertion of the connecting terminal pins 3*a*, 3*b*, 3*c* and 3*d* into the ring portions 16*a*. Thus, when the connecting terminal pins 3*a*, 3*b*, 3*c* and 3*d* are inserted into the ring portions 16*a*, electrical connection between each of the connecting terminal pins 3*a*, 3*b*, 3*c* and 3*d* and the corresponding coiled spring 16 is secured and the coiled spring 16 is accurately positioned, thereby resulting in improvement of the working efficiency.

Meanwhile, the coiled spring 16 having the ring portion 16*a* can be replaced by a conical coiled spring 17 having a ring portion 17*a* shown in FIG. 5(*d*). Since one end of the conical coiled spring 17 remote from the ring portion 17*a* is made smaller, in diameter, than the ring portion 17*a*, the conical coiled spring 17 is less subjected to inclination during use thereof than the coiled spring 16, whereby, electrical connection between each of the connecting terminal pins 3*a*, 3*b*, 3*c* and 3*d* and the conical coiled spring 17 is made more stable.

Figure 6A:
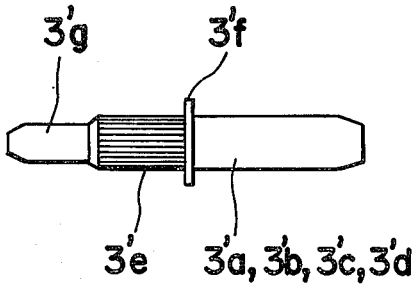
Figure 6B:
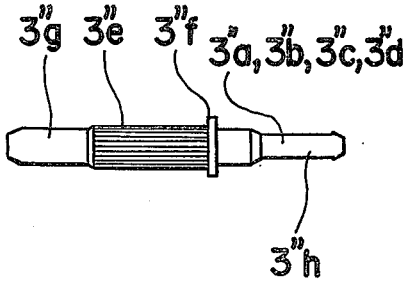

Furthermore, it is to be noted that each of the connecting terminal pins 3*a*, 3*b*, 3*c* and 3*d* is formed with a flange 3*f* for allowing the connecting terminals 3*a*, 3*b*, 3*c* and 3*d* to extend over a predetermined distance into the space portions 11Aa and 11Ab, the space portion for the connecting terminal pin 3*c* and the space portion for the connecting terminal pin 3*d*, respectively and a knurled portion 3*e* for preventing the connecting terminals 3*a*, 3*b*, 3*c* and 3*d* from being withdrawn out of the through-openings 11*a*, 11*b*, 11*c* and 11*d*, respectively and from being rotated. However, as shown in FIG. 6(*a*), the connecting terminal pins 3*a*, 3*b*, 3*c* and 3*d* can be replaced by connecting terminal pins 3′*a*, 3′*b*, 3′*c* and 3′*d* having a flange 3′*f*, a short knurled portion 3′*e* and an engagement portion 3′*g* for engagement with the ring portion 16*a* of the coiled spring 16. Moreover, the connecting terminal pins 3*a*, 3*b*, and 3*c* and 3*d* can be replaced by connecting terminal pins 3″*a*, 3″*b*, 3″*c* and 3″*d* having a flange 3″*f*, a short knurled portion 3″*e*, an engagement portion 3″*g* for engagement with the ring portion 16*a* of the coiled spring 16 and a small diameter end 3″h remote from the engagement portion 3″*g*. It is to be noted that the short knurled portions 3′*e* and 3″*e* are reduced, in length, to the through-opening extending concentrically with the insulating cover 7′*a*, through-opening 11*b*, through-opening extending concentrically with the insulating cover 7′*c* and through-opening for the connecting terminal pin 3*d* while the engagement portions 3′*g* and 3″*g* have a diameter corresponding to that of the ring portion 16*a* of the coiled spring 16.

Since in the high-voltage variable resistors K and K′, the connecting terminal pins 3*a*, 3*b*, 3*c* and 3*d* are substantially held by the insulating casings 6′ and 6″, respectively, there is a possiblity that, when the insulating casing 6′ and 6″ are subjected to shrinkage or deformation by heating of the thermosetting resin 8 for curing thereof, the connecting terminal pins 3*a*, 3*b*, 3*c* and 3*d* are not positively held by the insulating casing 6′ and 6″, respectively or a space 19A including regions of sliding movement of the sliding members 2*a* and 2*b* is deteriorated in heat resistance. Since other constructions of the high-voltage variable resistor K′ are similar to those of the high-voltage variable resistor K, description thereof is abbrebiated for brevity.

Figure 7:
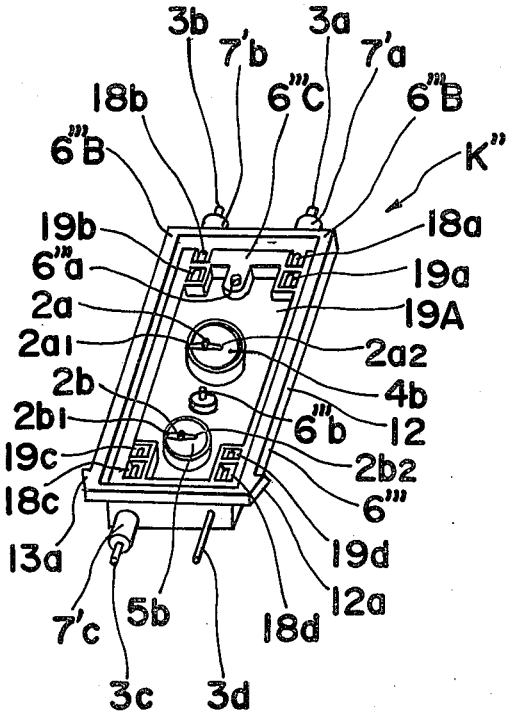
FIG. 7 is a perspective view of a high-voltage variable resistor according to a third embodiment of the present invention with its insulating substrate being removed therefrom.
Figure 8:
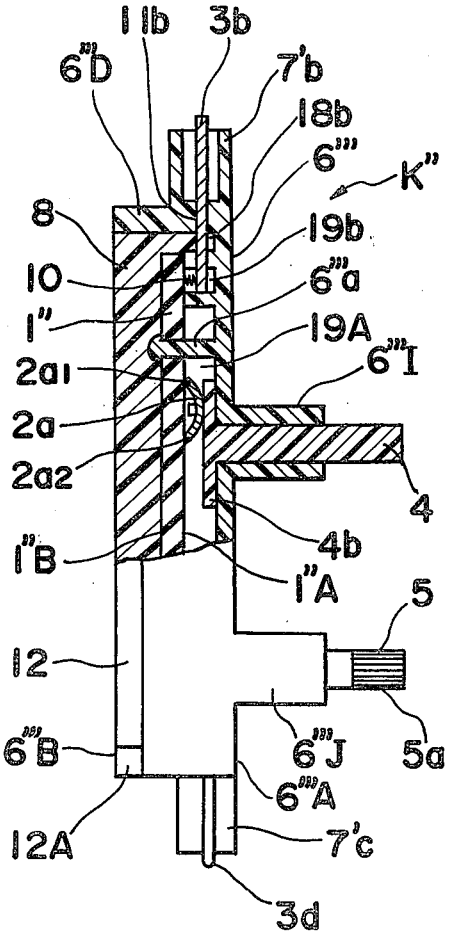
FIG. 8 is a view similar to FIG. 2(*b*), showing on an enlarged scale the high-voltage variable resistor of FIG. 7.

In order to eliminate such inconveniences as referred to above, there is shown in FIGS. 7 and 8, a high-voltage variable resistor K″ according to third embodiment of the present invention.

The high-voltage variable resistor K″ includes as insulating casing 6‴ having a front face 6‴A and a rear face 6‴B, and an insulating substrate 1″ having a front face 1″A and a rear face 1″B. The insulating casing 6‴ has space portions 19*a*, 19*b*, 19*c* and 19*d* each accommodating the coiled spring 10 therein, which are communicated with the through-opening extending concentrically with the insulating cover 7′*a*, through-opening 11*b*, through-opening extending concentrically with the insulating cover 7′*c* and through-opening for the connecting terminal pin 3*d*, respectively. The insulating casing 6‴ has, further, recess portions 18*a*, 18*b*, 18 *c* and 18*d* which are, respectively, formed in the course of the through-opening extending concentrically with the insulating cover 7′*a*, through-opening 11*b*, through-opening extending concentrically with the insulating cover 7′*c* and through-opening for the connecting terminal pin 3*d* so as to be communicated with the through-opening extending concentrically with the insulating cover 7′*a*, through-opening 11*b*, through-opening extending concentrically with the insulating cover 7′*c* and through-opening for the connecting terminal pin 3*d*. The thermosetting resin 8 is injected not only onto the rear face 1''B of the insulating substrate 1'' but into the recess portions 18*a*, 18*b*, 18*c* and 18*d*, whereby the insulating substrate 1'' is more positively held by the thermosetting resin 8 while the space 19A including regions of sliding movement of the sliding members 2*a* and 2*b* and the space portions 19*a*, 19*b*, 19*c* and 19*d* are more securely electrically insulated and shielded against atmosphere outside the insulating casing 6'''. At the same time, since a part of each of the connecting terminal pins 3*a*, 3*b*, 3*c* and 3*d* extending through the recess portions 18*a*, 18*b*, 18*c* and 18*d*, respectively, is molded by the thermosetting resin 8, the connecting terminal pins 3*a*, 3*b*, 3*c* and 3*d* are not only directly held by the insulating casing 6''' but fixed in position by the thermosetting resin 8. Since other constructions of the high-voltage variable resistor K'' are similar to those of the high-voltage variable resistor K, description thereof is abbreviated for brevity.

Furthermore, referring to FIGS. 9 to 13, there is shown a high-voltage variable resistor K''' according to a fourth embodiment of the present invention.

Figure 9:
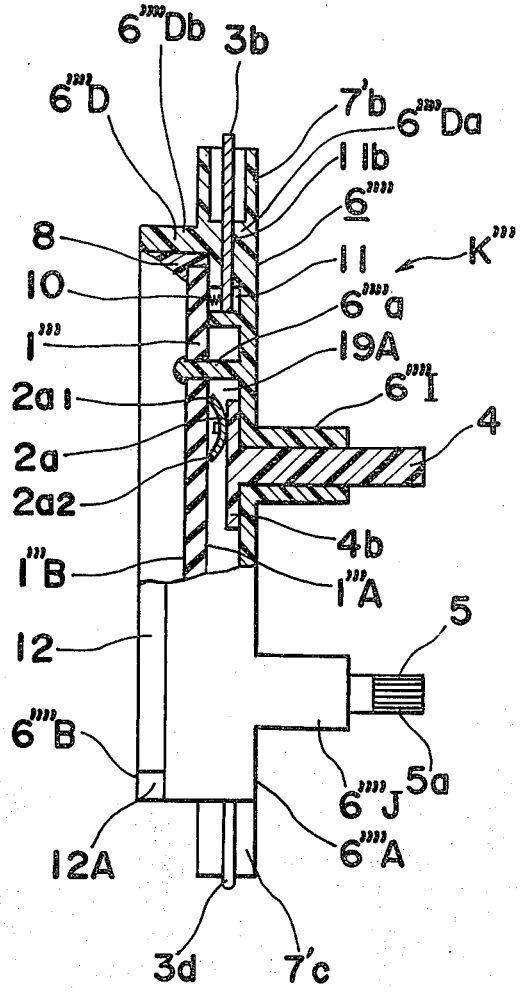
FIG. 9 is a view similar to FIG. 2(*b*), showing on an enlarged scale a high-voltage variable resistor according to a fourth embodiment of the present invention.
Figure 10:
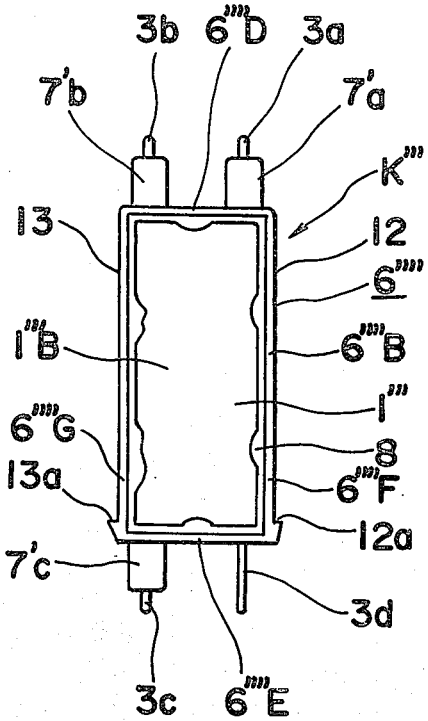
FIG. 10 is a rear elevational view of the high-voltage variable resistor of FIG. 9.

The high-voltage variable resistor K''' includes an insulating casing 6'''' having a front face 6''''A and a rear face 6''''B, and an insulating substrate 1''' having a front face 1'''A and a rear face 1'''B. Although the thermosetting resin 8 is applied to the whole surface of each of the rear faces 1'B, 1'B and 1''B of the insulating substrate 1', 1', and 1'' in the high-voltage variable resistors K, K' and K'', respectively, the thermosetting resin 8 is applied only to the periphery of the insulating substrate 1''' in the high-voltage variable resistor K''' so that almost all the rear face 1'''B may be exposed to atomosphere as best shown in FIGS. 9 and 10. Since the insulating substrates 1', 1'' and 1''' made of alumina, etc. are far greater, in thermal conductivity, than the thermosetting resin 8 such as epoxy resin, etc., the thermosetting resin 8 is provided only at the periphery of the insulating substrate 1''' in order to radiate heat produced at a resistor portion (not shown) of the insulating substrate 1''' out of the insulating casing 6'''' rapidly. Meanwhile, although the insulating substrates 1', 1'' and 1''' are superior, in voltage resistance, water absorbing capacity and heat resistance, to the thermosetting resin 8, the above described excellent properties of the insulating substrates 1', 1' and 1'' are not fully utilized in the high-voltage variable resistors K, K' and K'', respectively. It should be noted here that since the thermosetting resin 8 is used mainly for electrically insulating the insulating substrates 1', 1'' and 1''', provision of the thermosetting resin 8 only at the periphery of the rear face 1'''B is sufficient therefor. Thus, the excellent properties of the insulating substrate 1''' can be utilized to full extent.

Figure 11:
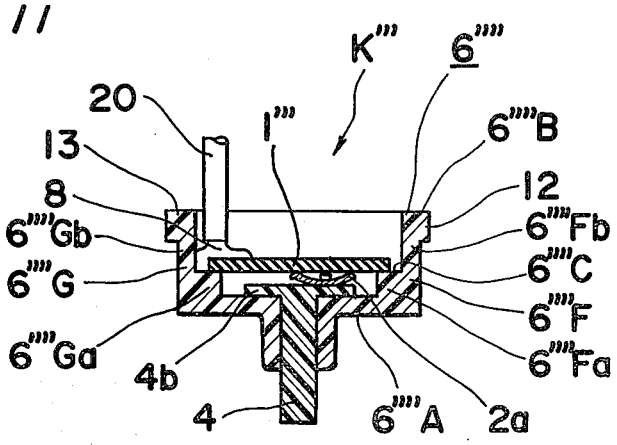
FIG. 11 is a view explanatory of injection of thermosetting resin in the high-voltage variable resistor of FIG. 9, and FIGS. 12 and 13 are views showing on an enlarged scale insulating casings of various configurations employed in the high-voltage variable resistor of FIG. 9.
Figure 12:
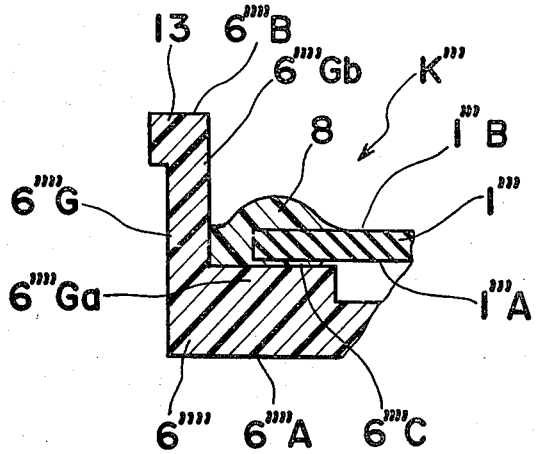
Figure 13:
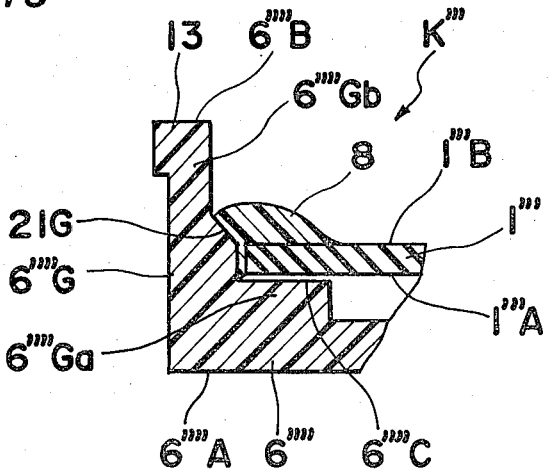

Hereinbelow, a method of injecting the thermosetting resin 8 at the periphery of the insulating substrate 1''' and a structure of the insulating casing 6'''' suited therefor will be described with reference to FIGS. 11 to 13. When the insulating substrate 1''' is placed on a bearing face 6''''C with the connecting terminal pins 3*a*, 3*b*, 3*c* and 3*d* being electrically connected to the insulating substrate 1''' through the coiled springs 10, respectively, a proper amount of the thermosetting resin 8 is dropped at a plurality of locations along the periphery of the insulating substrate by using a nozzle 20 as shown in FIG. 11. Then, the dropped thermosetting resin 8 is heated for curing. The thermosetting resin 8 is lowered, in viscosity, temporarily by heating of the thermosetting resin 8 so as to spread between the insulating casing 6'''' and the insulating substrate 1''', whereby the dropped thermosetting resin 8 is linked with one another so as to seal the periphery of the insulating substrate 1'''. It is to be noted that the nozzle 20 is required to be spaced a slight distance from inner peripheries of rear wall portions 6''''D*b*, 6''''F*b* and 6''''G*b* of an upper side wall 6''''D, a left side wall 6''''F and a right side wall 6''''G, and of a rear wall portion of a lower side wall 6''''E, respectively. For example, if peripheral edges of the insulating substrate 1''' is disposed excessively adjacent to the inner peripheries of the rear wall portions 6''''D*b*, 6''''F*b* and 6''''G*b*, and of the rear wall portion of the lower side wall 6''''E and peripheral edges of the insulating substrate 1''' are improperly sealed by the thermosetting resin 8 in case of a slight displacement of the nozzle 20 from its predetermined position when a small amount of the thermosetting resin 8 is dropped thereon. Meanwhile, in the case where the peripheral edges of the insulating substrate 1''' are displaced a rather large distance from the inner peripheries of the rear wall portions 6''''D*b*, 6''''F*b* and 6''''G*b* and of the rear wall portion of the lower side wall 6''''E so as to eliminate improper sealed portions, the thermosetting resin 8 tends to spread only into a clearance between the insulating substrate 1''' and the bearing face 6''''C, thus resulting in improper sealing of the insulating substrate 1''' as shown in FIG. 12. Accordingly, in order to eliminate the above described disadvantage, the insulating casing 6'''' further has a tapered portion 21G (FIG. 13) formed on the inner periphery of the rear wall portion 6''''G*b*. In the same manner as described above, the rear wall portions 6''''D*b* and 6''''F*b* and the rear wall portion of the lower side wall 6''''E are formed with tapered portions, respectively, so that adhesion area of the thermosetting resin 8 is enlarged and improper sealing of the insulating substrate 1''' is eliminated. Since other constructions of the high-voltage variable resistor K''' are similar to those of the high-voltage variable resistor K, description thereof is abbreviated for brevity.

In accordance with the present invention, since the connecting terminal pins are disposed in parallel with the opposite surfaces of the insulating substrate and are electrically connected to the insulating substrate through the springs, it becomes unnecessary to perform the hitherto required soldering process and flux washing process. Meanwhile, even if an external force is applied to the connecting terminal pins, the springs act as shock absorbers so that damage to the insulating substrate or improper electrical connection between the insulating substrate and the connecting terminal pins may be eliminated, whereby working efficiency and reliability of the high-voltage variable resistor have been remarkably improved.

Meanwhile, in accordance with the present invention, since the coiled spring is provided with the ring portion through which the collecting terminal pin is inserted, and a groove is formed on the front wall of the insulating casing defining the bottom of the space portion for accommodating the coiled spring therein so that a part of the ring portion may be fitted into the groove, electrical connection between the connecting terminal pins and the insulating substrate is more positively secured and the coiled spring can be brought into engagement with the connecting terminal pin more easily.

Furthermore, in accordance with the present invention, since a recess portion is provided in the course of the through-opening of the connecting terminal pin so as to be communicated with the through-opening and a part of the connecting terminal pin extending through the recess portion is molded by the thermosetting resin, the connecting terminal pins are securely held by the insulating casing even if the insulating casing is subjected to deformation by heating of the thermosetting resin for curing thereof and thus, reliability of the high-voltage variable resistor has been remarkably improved. Meanwhile, the space including regions of sliding movement of the sliding members are sufficiently shielded against atmosphere outside the insulating casing and therefore, is improved in humidity resistance.

Moreover, in accordance with the present invention, since the thermosetting resin is applied only to the periphery of the insulating substrate, heat produced at the resistor portion of the insulating substrate is rapidly radiated out of the insulating casing and the high-voltage variable resistor is prevented from being adversely affected by heat. Meanwhile, since the insulating substrate can be made smaller in size, the high-voltage variable resistor can be made compact in size and light in weight.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A high-voltage variable resistor comprising:

a planar substrate member;

a plurality of electrodes formed on one surface of said substrate member;

a resistor element formed by deposition of conductive material on said one surface of said substrate member, said resistor element having its ends electrically connected to two of said electrodes and having intermediate said ends at least one circular portion;

a casing formed of insulating material for accommodating said substrate member, said substrate member being positioned within said casing with said one surface facing the interior area thereof, said casing being formed with a plurality of interior wall portions forming a plurality of space portions separated from said interior area;

a sliding contact member rotatably arranged in said interior area of said casing in sliding contact with said circular portion of said resistor element;

a rotational rod in said casing coupled with said sliding contact member so as to rotate said sliding contact member, said rotational rod projecting out of said casing;

a plurality of connecting terminals disposed parallel to said one surface of said substrate member, each of said terminals extending through said casing into a respective one of said space portions; and spring means accommodated in each of said space portions and connecting each of said connecting terminals to a respective one of said electrodes.

2. A high-voltage variable resistor comprising:

a planar substrate member;

a plurality of electrodes formed on one surface of said substrate member;

a resistor element formed by deposition of conductive material on said one surface of said substrate member, said resistor element having its ends electrically connected to two of said electrodes and having intermediate said ends at least one circular portion;

a casing formed of insulating material for accommodating said substrate member, said substrate member being positioned within said casing with said one surface facing the interior area therof, said casing being formed with a plurality of internal wall portions forming a plurality of space portions separated from said interior area;

a sliding contact member rotatably arranged in said interior area of said casing in sliding contact with said circular portion of said resistor element;

a rotational rod in said casing coupled with said sliding contact member so as to rotate said sliding contact member, said rotational rod projecting out of said casing;

a plurality of connecting terminals disposed parallel to said one surface of said substrate member, each of said terminals extending through said casing into a respective one of said space portions; and a coiled spring accommodated in each of said space portions and connecting each of said connecting terminals to a respective one of said electrodes, each of said coiled springs being formed with a ring portion through which each of said connecting terminals is inserted, and said interior wall portions of said space portions being formed with grooves therein into which a part of said ring portion may be fitted.

3. A high-voltage variable resistor as claimed in claim 1, wherein said spring means are coiled springs.

4. A high-voltage variable resistor as claimed in claim 1, wherein said spring means are V-shaped spring plate.

5. A high-voltage variable resistor as claimed in claim 4, wherein each of said V-shaped spring plate has a projecting contact formed on one side thereof for engagement with each of said electrodes of said substrate.

6. A high-voltage variable resistor as claimed in claim 1, wherein said connecting terminals, respectively, extend through a plurality of through-openings formed on said casing, a predetermined space in said casing, except for regions of sliding movement of said sliding members being molded by resin, a plurality of recess portions being, respectively, formed in the course of said through-openings so as to be communicated with said through-openings, said resin being also applied to said recess portions so as to hold a part of each of said connecting terminals extending through said recess portions.

7. A high-voltage variable resistor as claimed in claim 1, wherein resin is applied to a periphery of said substrate accommodated in said casing so as to seal said periphery of said substrate.

8. A high voltage variable resistor as claimed in claim 7, wherein wall portions adjoining a bearing face for supporting said substrate are, respectively, formed with tapered portions in said casing.

* * * * *